US010406075B2

(12) United States Patent
Mogilefsky

(10) Patent No.: US 10,406,075 B2
(45) Date of Patent: Sep. 10, 2019

(54) DOSAGE MANAGEMENT SYSTEM

(71) Applicant: Arthur Allen Mogilefsky, Arroyo Grande, CA (US)

(72) Inventor: Arthur Allen Mogilefsky, Arroyo Grande, CA (US)

( * ) Notice: Subject to any disclaimer, the term of this patent is extended or adjusted under 35 U.S.C. 154(b) by 0 days.

(21) Appl. No.: 15/998,291

(22) Filed: Jul. 30, 2018

(65) Prior Publication Data

US 2019/0183735 A1 Jun. 20, 2019

Related U.S. Application Data

(60) Provisional application No. 62/708,625, filed on Dec. 14, 2017.

(51) Int. Cl.

| | |
|---|---|
| ***B65D 83/04*** | (2006.01) |
| ***A61J 7/00*** | (2006.01) |
| ***A61J 1/03*** | (2006.01) |

(52) U.S. Cl.

CPC ..... *A61J 7/0069* (2013.01); *A61J 1/03* (2013.01); *A61J 2205/20* (2013.01); *A61J 2205/30* (2013.01); *A61J 2205/40* (2013.01)

(58) Field of Classification Search

CPC ..... A61J 1/03; A61J 7/0069; A61J 2205/20; A61J 2205/30; A61J 2205/40

USPC ..... 206/1.5, 468, 528, 534, 538, 539, 562, 206/563, 564, 565; 220/345.1, 345.2, 220/345.3

See application file for complete search history.

(56) References Cited

U.S. PATENT DOCUMENTS

| | | | | | |
|---|---|---|---|---|---|
| 1,325,349 | A * | 12/1919 | Burgess | B65D 9/32 | 217/62 |
| 2,035,340 | A * | 3/1936 | Primavera | B65D 7/065 | 206/37 |
| 3,362,564 | A * | 1/1968 | Mueller | B65D 43/20 | 220/345.3 |
| 4,982,843 | A * | 1/1991 | Jones | A61B 50/362 | 206/366 |
| 5,080,222 | A * | 1/1992 | McNary | B65D 50/045 | 206/1.5 |
| 5,299,711 | A * | 4/1994 | Romick | B65D 43/12 | 206/534 |
| 8,480,969 | B2 * | 7/2013 | Fukuzawa | A61B 5/14532 | 206/1.5 |

(Continued)

*Primary Examiner* — Luan K Bui

(74) *Attorney, Agent, or Firm* — Arthur Mogilefsky

(57) ABSTRACT

This invention relates to a dosage management system that comprises a container including a box with an opening towards the top. The box has a first side with an opposing second side and a third side. The box has a pair of parallel grooves in the first side and second side and a tray inside the box. There is also provided a resilient sliding lid. The lid has two parallel opposing edges that slidingly engage the grooves. At least one of the edges and grooves has a catch and notch combination that engage when the lid is in a closed position. The grooves have a first incline or decline part connected to a substantially horizontal part which is again connected to a second incline or decline part. When opening the box, the lid is pushed down the lid then bending into the horizontal part, the notch and catch disengaging and the lid is moved to the third side to open the box. Closing the box is accomplished by pushing the lid back towards the closing position and the catch is urged into the notch due to the lid regaining its shape.

20 Claims, 12 Drawing Sheets

(56) References Cited

U.S. PATENT DOCUMENTS

| | | | | |
|---|---|---|---|---|
| 2006/0071002 | A1* | 4/2006 | Hurst | A61B 50/30<br>220/345.1 |
| 2019/0062018 | A1* | 2/2019 | McClellan | B65D 71/70 |

* cited by examiner

DOSAGE MANAGEMENT SYSTEM

PRIORITY

This nonprovisional application claims priority from a provisional application No. 62/708,625 filed on the 14 Dec. 2017 at the United States Patent and Trademark Office with the title Dosage Management System.

BACKGROUND OF THE INVENTION

People taking measured quantities of substances like chronic medication to manage their state of health and wellbeing need different dosages of medication or different types of medication altogether. It depends on the severity of the symptoms they experience and or the level of relief they are trying to achieve. On a good day when the discomfort such a person experiences is less severe for instance he may need to take a relative low dosage. However, on another day when he experiences a higher level of discomfort he may have to take a higher dosage.

It may be that initially the anticipated level of dosage needed at the start of a day may be relatively low. However, as the day progresses it may be found that the dosage level has to be increased to achieve the desired result. On the other hand, the anticipated required dosage may initially be high but later it may be found that the dosage level can be decreased to obtain satisfactory results. It may also be that the type of medication has to be changed during the day.

There is however a limited amount that of the substance that may be safely taken over a set period of time in order not to overdose or experience bad side effects. This may vary according to a person's age, weight, or sex. It often happens that a person may not remember the initial dosage he initially took at the start of a day. He may therefore not know how much more of the substance he safely can take for the rest of the day without exceeding the maximum limit. This can be particularly so if the substance person uses comes in different dosages or the person uses different kinds of medication. This invention can be used to assist a person to keep track of medication or measured quantities he has already taken or consumed.

This invention can be for instance used by a person that uses chronic pain medication. This invention is not limited to prescription medication. This invention can also be used for other substances such is supplements like minerals, vitamins and herbs. It can also be used for measured quantities manufactured by the user himself or someone else. For example, it is possible for a person to purchase empty capsules and herbs, minerals, vitamins, food supplements and other substances separately. A person can then fill these empty capsules with these separate herbs, minerals, vitamins, food supplements and other substances or any combination thereof or dosage as desired. This invention can thus also be used for these self-filled homemade capsules. Even, herbs, minerals, vitamins and other food supplements all have a required or recommended dosage associated with them.

With advances in three-dimensional printing and the advent of personalized and customized medication, measured quantities as medication will become available. This type of medication is designed for a specific person and his specific condition. The medication will therefore be personalized and custom designed. The medication can be made in virtually any shape. There will be no standard dosage and instructions available for the medication as is the case with standard commercial medication. The dosage and instructions will thus be specific to the user or patient for whom it was designed. Special care will have to be taken that a person takes the correct amount of medication. This will be particularly so for people who can easily can get confused such as the elderly and illiterate people.

This invention will try to assist a person not to exceed the maximum dosage of the substance he is using. This invention can also be used to assist the user to record the amount of the substance he has taken within a set period.

This invention can be used by any person who takes a substance in a measured quantity on a regular basis and wishes to monitor and or manage the dosage of the substance over a given time period. The measured quantity can be in the form of a capsule, pill, tablet or any other shape. It can the form of a powder, granular, crystal like, a mixture, gel, paste or even liquid or any other form.

BRIEF SUMMARY OF THE INVENTION

This invention relates to a tray to hold measured quantities for human consumption; the tray having receptacles for receiving measured quantities and the receptacles are grouped together by dosage and or contents of the measured quantities.

The group the receptacles are grouped together may be indicated on the tray. The receptacles may have more than one profile and the receptacles may be grouped together according to their profile. The tray may contain measured quantities that have profiles that correspond to the profiles of the receptacles. The receptacles may have resilient structures to accept measured quantities of different diameters and or profiles. The receptacles may comprise compressible longitudinal sections arranged like spokes of a wheel in a circle around a central hub zone and the measured quantity may fit in the central hub zone.

The receptacles may have more than one profile and at least one of the receptacles may be a resilient structure. The tray may contain a measured quantity that has an indication that is representative of its contents or dosage. The measured quantity may contain an indication by color that is representative of its contents or dosage.

The invention also relates to a container comprising a box with an opening towards the top; the box having a first side with an opposing second side and a third side; the box having a pair of parallel grooves in the first side and second side; and a resilient sliding lid. The lid may have two parallel opposing edges that slidingly engage the grooves; at least one of the edges and grooves having a catch and notch combination to engage when the lid is in a closed position. The grooves may have a first incline or decline part connected to a substantially horizontal part which is again connected to a second incline or decline part so that when opening the box the lid is pushed down the lid then bending into the horizontal part, the notch and catch disengages and as the lid is moved to the third side to open the box. Closing of the box is accomplished by pushing the lid back towards the closing position and the catch is urged into the notch due to the lid regaining its shape.

The lid may have a stopper and when the container is opened, and the lid slides open the stopper is stopped by the third side of the box and so prevents the lid from sliding off the box. The third side may have a gap and the box may have opposite the third side a fourth side with a gap. The lid may have two stoppers spaced apart; each stopper having associated with it a gap in one of the third or fourth sides of the box through which it travels, if the lid is moved in one direction and each stopper may have associated with it an opposite side of a box which stops the stopper and so preventing the lid from sliding off the box if the lid is moved in the opposing direction.

The lid may have a lock that comprises an arm that is rotatable around a swivel that is attached to the lid. The arm may be rotatetable into a locking position when the arm engages a fastener attached to the lid and the arm is close and above the catch and notch combination the arm resting on a side that contains the catch and notch combination. This may prevent the lid from being bent inwards and the catch and notch combination from disengaging and so preventing the lid from being slid open. The arm may be rotatetable to an unlocking position when the arm does not engage the fastener and is not close and above the catch and notch combination and the arm does not rest on a side of the box that contain the catch and notch combination. The lid may now be capable of being bent inwards and the lid can be slid open.

This invention also relates to a dosage management system comprising: a container including a box as previously described and the tray as previously described is inside the box.

DESCRIPTION

TABLE OF NUMERALS

| Numeral | Description |
|---|---|
| 10 | Capsule |
| 20 | Tray |
| 30 | Dosage Indication |
| 40 | Receptacle |
| 50 | Capsule in Receptacle |

-continued

TABLE OF NUMERALS

| Numeral | Description |
|---|---|
| 60 | Divisional Ridge |
| 70 | Measured Quantity with Triangular Profile |
| 80 | Measured Quantity with Square Profile |
| 90 | Measured Quantity with Polygon Profile |
| 100 | Receptacle with Resilient Structure Configuration |
| 110 | Longitudinal Section |
| 120 | Central Hub Zone |
| 130 | Sliding Lid |
| 140 | Front Edge |
| 150 | Back Notch (gap) |
| 160 | Front Catch (protrusion) |
| 170 | Box |
| 180 | Right Gap |
| 190 | Back Stopper |
| 200 | Front Stopper |
| 210 | Right Side |
| 220 | Back Grove |
| 230 | Front Grove |
| 240 | Front Notch (gap) |
| 250 | Back Catch (protrusion) |
| 260 | Left Gap |
| 270 | Left Side |
| 290 | Back Edge |
| 300 | Back Lower Level Portion |
| 310 | Front Lower Level Portion |
| 320 | Back Left Ramp |
| 330 | Back Left Taper |
| 340 | Back Right Ramp |
| 350 | Back Right Taper |
| 360 | Back Upper Level Portion |
| 370 | Front Left Ramp |
| 380 | Front Upper Level Portion |
| 390 | Front Left Taper |
| 400 | Front Right Ramp |
| 410 | Front Right Taper |
| 420 | Right End |
| 430 | Left End |
| 440 | Ventilation Hole |
| 445 | Ventilation Hole on Lock |
| 450 | Lock |
| 460 | Opening Instructions |
| 465 | Circular Central Part |
| 470 | First Arm |
| 471 | First Fastener |
| 472 | First Side |
| 475 | Second Arm |
| 476 | Second Fastener |
| 477 | Second Side |
| 480 | Swivel |
| BGFID | Back Groove First Incline or Decline Part |
| BGSH | Back Groove Substantially Horizontal Part |
| BGSID | Back Groove Second Incline or Decline Part |
| FGFID | Front Groove First Incline or Decline Part |
| FGSH | Front Groove Substantially Horizontal Part |
| FGSID | Front Groove Second Incline or Decline Part |

Figure 1:
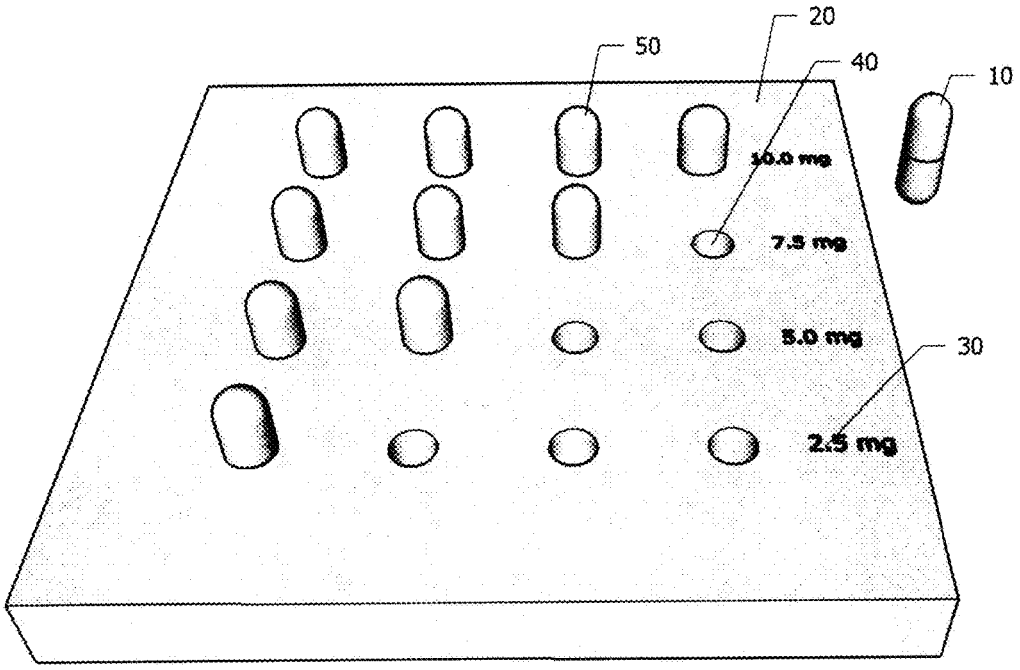
FIG. 1—Shows tray with circular receptacles and capsules.

Shown in FIG. 1 is tray 20 with receptacle 40. In this case the receptacle 40 is circular shaped or has a circular profile if viewed from above. In this case, the measured quantity is a capsule 10 shown on the side next to tray 20. The capsule 50 is shown as a capsule in a receptacle. The receptacles in this case are arranged in a 4 row by 4-column matrix on tray 20. In this embodiment next to each row on the right hand, side is dosage indication 30. It must be understood that dosage indication need not necessary be by row but can also be by column. Further, this invention is not limited to this particular arrangement of rows and columns. The rows and columns can be any amount. The rows and columns do not have to be the same number of rows and columns. There can be different amounts of receptacles in the rows and columns.

Capsule 10 can have an indication that is representative of its contents or dosage. This indication can be by color. So, for instance, a capsule having the color of green in appearance can be representative of 2.5 mg dosage, a blue appearance can be an indication of a dosage of 5.0 mg, a yellow appearance can be an indication of a dosage of 7.5 mg and red can be an indication of 10.0 mg. The color can be because of the color of the capsule itself or it can be because of the contents of the capsule that is placed in a transparent capsule. It need of course not necessarily be by color only. The contents can have different colors and textures due to the mixtures of the different ingredients that the contents of the capsule may contain.

Capsule 10 can also have different markings on it that gives an indication of its dosage or contents. It can contain a circle on its circumference or multiple circles. It can also have any other marking such as a square, triangle, dot, polygon, numeral, letter, or any combination thereof. The capsule can have different color combinations for instance the top can be blue and bottom part red. It can be opaque, transparent or semi-transparent.

Figure 2:
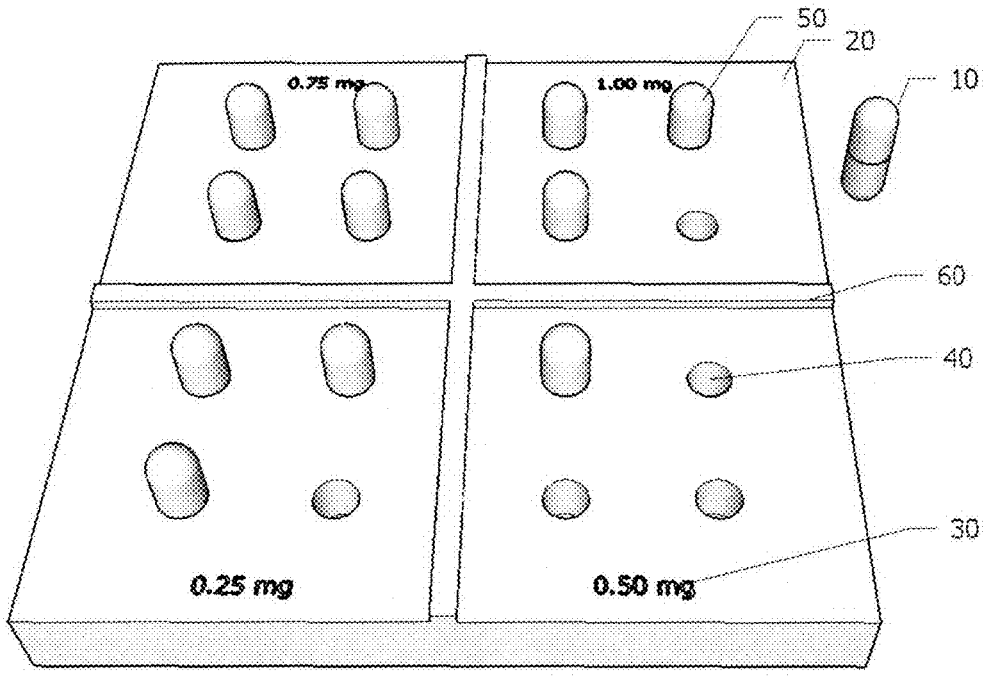
FIG. 2—Shows tray with receptacles with dosage divided in tray quarters.

In FIG. 1 the dosage was grouped by row. As mentioned, dosage can also be grouped by column. This is not the only way dosage can be grouped. There are various ways dosage can be grouped. In FIG. 2, the tray is divided by ridge 60 in four quarters. The lower left quarter four receptacles are grouped in this case to have a dosage of 0.25 mg. The lower right quarter four are grouped to have a dosage of 0.50 mg as shown by dosage indication 30 in FIG. 2. The upper left quarter is grouped to have a dosage of 0.75 mg and upper right quarter is grouped to have a dosage of a 1.0 mg. The division of course does not always have to be in four groups. Each group does not necessarily have to have four receptacles. It will all depend on the particular application. The division does not have to be limited according to dosage but can also be according to the contents of the capsule or it can be according to both.

Figure 3:
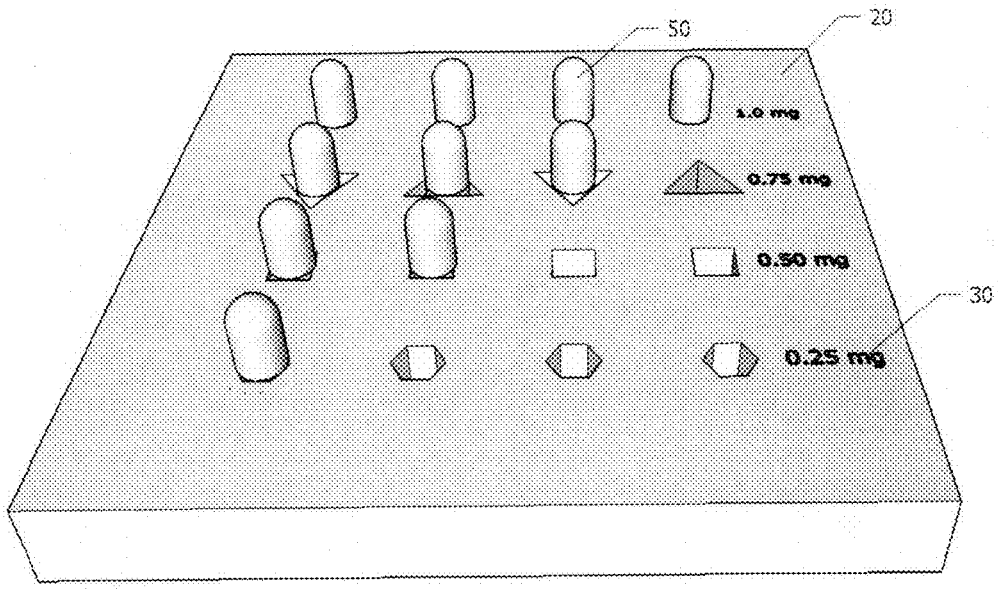
FIG. 3—Shows tray with different profile receptacles, with circular profile measured quantities namely capsules when viewed from above.

As can be seen in FIG. 3 the profile of the receptacle as seen from above does not have to be a circle. It can be any shape. It does not have to have the same profile as that of the measured quantity. These different profile receptacles can serve to assist a person to identify different measured quantities such as medication. As shown in FIG. 3 the receptacle can be circular, triangular, square shaped or in the shape of a polygon or any other shape. To help identify medication or supplement especially the elderly or illiterate people measured quantities of a certain dosage can be placed in the row of circular receptacles. Another dosage or a different type of measured quantity like another type of medication can be placed in the row of triangular receptacles. Subsequently the receptacles having rectangular and polygon profiles can further be used to distinguish the measured quantities like the medication. The invention is not limited to the shape of the receptacles shown in FIG. 3. The receptacles can be of any shape.

Figure 4:
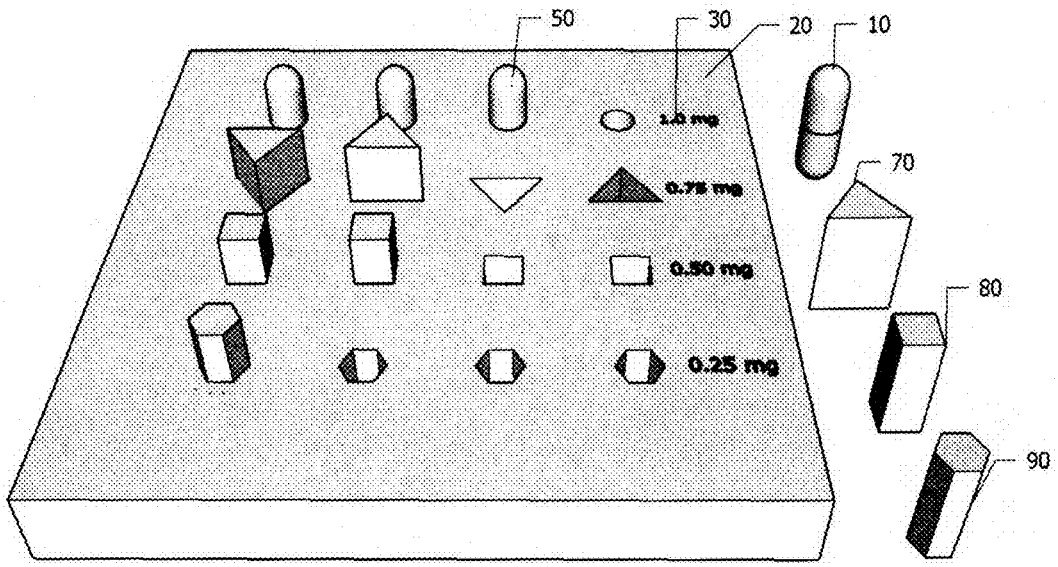
FIG. 4—Shows tray with different profile receptacles with corresponding same profile measured quantities.

In FIG. 4 the measured quantities have circular (like capsule 10), triangular 70, rectangular 80 and polygon 90 profiles if viewed from above. In this case as shown, in FIG. 4 the measured quantities are placed in the corresponding same profile receptacle. In this case, the fact that the medication fits only in a receptacle of a certain profile serves as a further method to control or identify a measured quantity such as medication. As shown in FIG. 4 this can be used in conjunction with the substance or dosage indication 30 as a further safeguard to help identify the measured quantity.

It should be understood that the receptacles for the different profiles do not have to be same number. It can be that for circular profiles there is a row of 5 receptacles. For the triangular profile, there is a row of three receptacles. For the square profile receptacle, the row may have four receptacles whereas in the case of the polygon profile there may be only two receptacles.

The tray can be manufactured out of inflexible material like wood, metal or plastic. The tray can also be manufactured out of resilient flexible material like rubber or sponge like material allowing the measured quantities to fit more snugly in the receptacles in the tray. Depending on the application, the use of resilient material in the manufacture of the tray may allow for measured quantities of different sizes or diameters to be placed in the same receptacle. However, it is possible to configure a receptacle such that the profile of the receptacle is adaptive and can receive measured quantities of different sizes or diameters.

Figure 5:
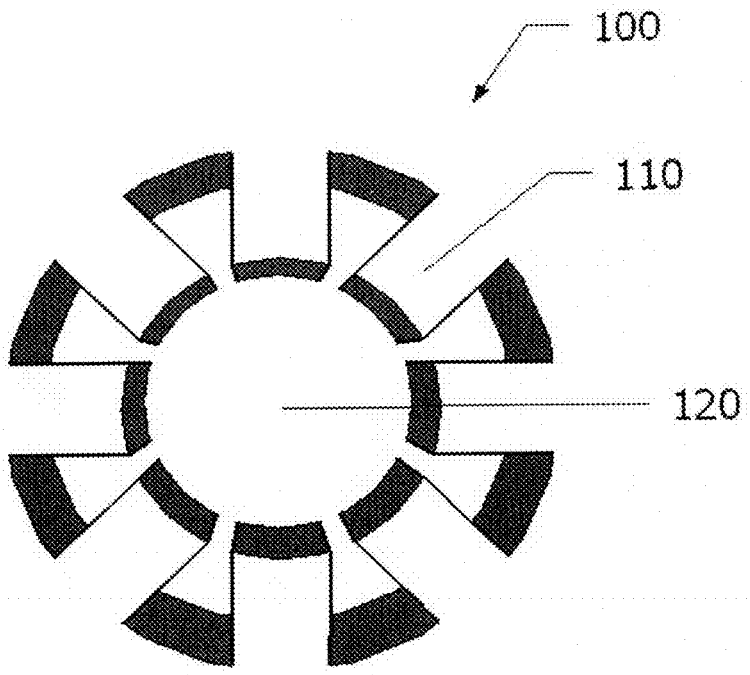
FIG. 5—Shows receptacle with resilient configuration profile made up of longitudinal spokes with central hub.

Shown in FIG. 5 is an example where the receptacle is made of resilient material like rubber. The receptacle with resilient structure configuration 100 is made up of longitudinal sections 110 that are arranged like spokes of a wheel in a circle around central hub zone 120. The measured quantity fits in the central hub zone 120. As the longitudinal sections 110 are compressible and can increase and decrease in length. The central hub zone 120 can also accordingly increase and decrease is size. If a measured quantity of an increased diameter is placed in the central hub zone 120 the longitudinal sections 110 are compressed and central hub zone 120 increases in size so that the measured quantity of an increased diameter or size fits. With this configuration measured quantities of various diameters or sizes can fit in this receptacle with a resilient structure configuration 100.

Figure 6:
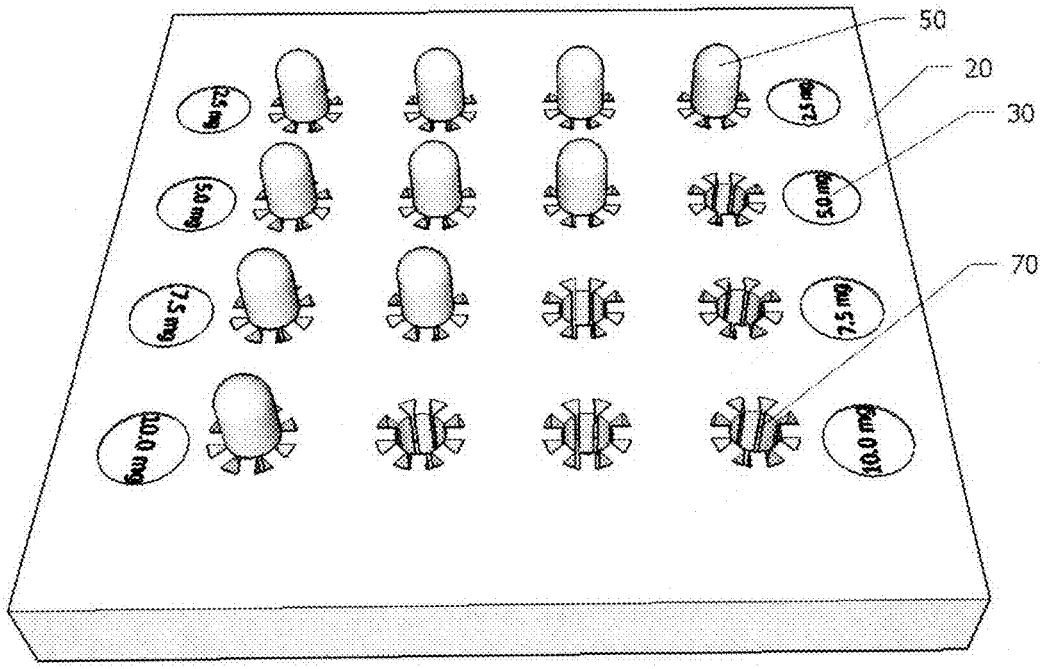
FIG. 6—Shows tray with receptacles having resilient configuration profile.

FIG. 6 shows tray 20 with resilient structure 100 and having capsule 50 in FIG. 5 in a receptacle with a resilient structure. The tray may contain one or more receptacles with resilient structures and one or more receptacles with fixed profiles or different profiles or any combination thereof. Also shown in FIG. 6 is circular dosage indication 30 on both sides of the rows on a circular indentation. This dosage indication is a circular sticker onto which the dosage is printed. The dosage can also be hand written on the circular sticker.

Figure 7:
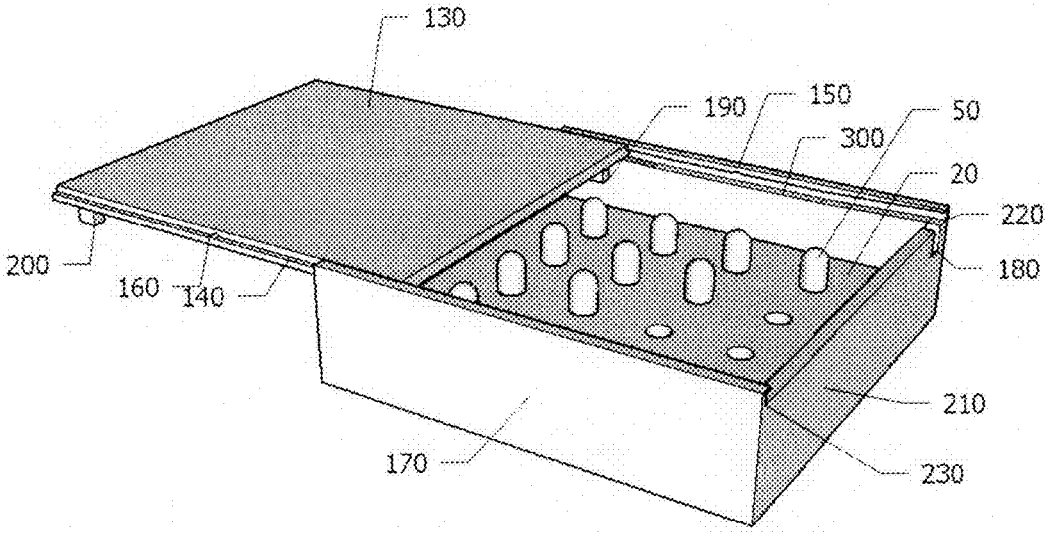
FIG. 7—Shows front right view of tray with capsules in box with sliding lid.
Figure 8:
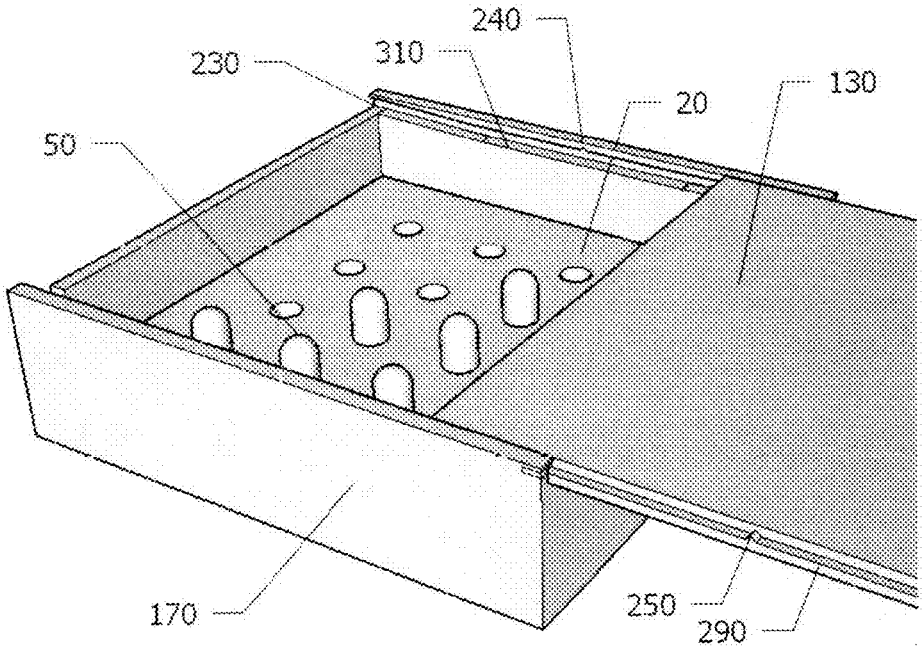
FIG. 8—Shows back left view of tray with capsules in box with sliding lid.

FIG. 7 shows a container, a box 170 with an opening towards the top and having a sliding lid 130 covering the opening. The sliding lid 130 keeps the contents of the box clean and prevents it from falling out. The box 170 has tray 20 with capsule in receptacle 50. Box 170 has on the inside and close to the opening a pair of parallel grooves, firstly back groove 220 with lower portion 300 is shown in FIG. 7. FIG. 8 shows back left view of tray with capsules in box with sliding lid. Front groove 230 with lower portion 310 is shown in FIG. 8. Sliding lid 130 has two parallel opposing edges. They are firstly back edge 290 shown in FIG. 8 slidingly engaging back groove 220 shown in FIG. 7. Secondly, sliding lid 130 has front edge 140 in FIG. 7 slidingly engaging front groove 230 shown in FIG. 8. Shown in FIG. 7 back groove 220 has back notch 150. In FIG. 8 front groove 230 has front notch 240. Further shown in shown in FIG. 8 back edge 290 has back catch 250. In FIG. 7 it can be seen that front edge 140 has front catch 160.

Shown in FIG. 7 sliding lid 130 has front stopper 200 and diagonally across back stopper 190. Box 170 has on right side 210 back right gap 180. Shown in FIG. 9 box 170 also has diagonally across left gap 260 in left side 270.

Figure 10:
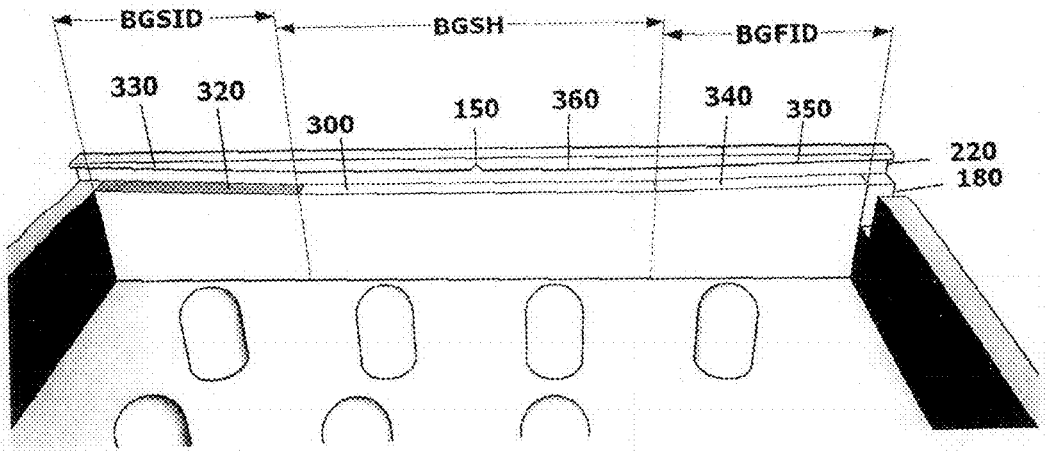
FIG. 10—Shows back groove.

FIG. 10 shows the back groove 220 of the box. Back groove 220 is generally composed of three parts. When box 170 is in an upright position with opening facing upwards back groove 220 has a back groove first incline or decline part BGFID connected to a back groove substantially horizontal part BGSH, which again is connected to a back groove second incline or decline part BGSID.

The first back groove incline or decline part BGFID of back groove 220 is firstly formed by back right ramp 340, which is at a decline from the outside box 170 towards back lower level portion 300. Secondly the first incline or decline part BGFID of back groove 220 is formed in that above back right ramp 340 is back right taper 350 tapering towards the outside of box 170 so that the height of back groove 220 remains substantially the same above back right ramp 340.

The substantially horizontal part BGSH of back groove 220 is formed as shown in FIG. 10 firstly by back upper level portion 360. Secondly opposite and below upper level portion 360 is back lower level portion 300. In back upper level portion 360 is back notch 150.

The back groove second incline or decline part BGSID of back groove 220 is formed by as shown in FIG. 10 firstly by back left ramp 320 which is at an incline leading to the outside of the box towards the left. Secondly it is formed by back left taper 330 which tapers towards the outside of the box so that the height of the groove remains substantially the same above back left ramp 320.

Figure 11:
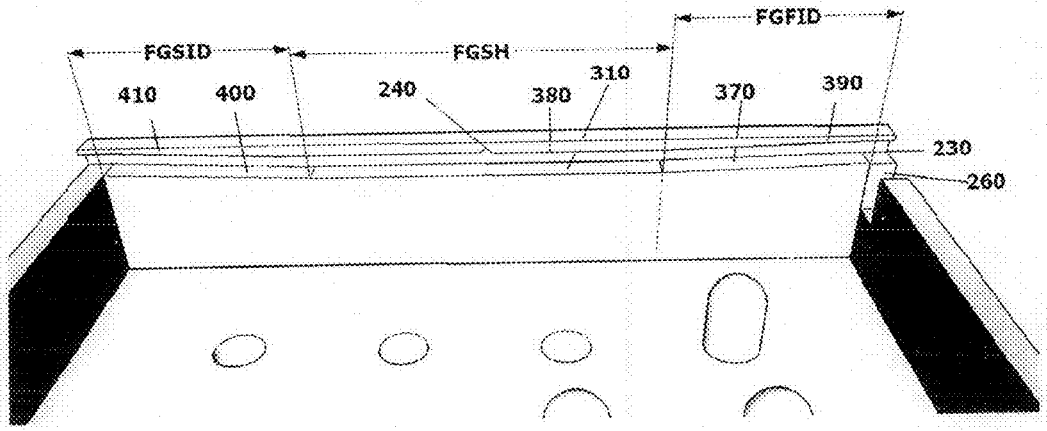
FIG. 11—Shows front groove.

FIG. 11 shows the front groove 230 viewed from the back in other words looking from the back towards the front. This of course means what is shown in FIG. 11 on the right is on the left and what is on the right is on the left if compared when viewed from the front. For purposes of uniformity, the features are named as if viewed from the front.

Front groove 230 in FIG. 11 is structurally the same as back groove 220 in FIG. 10. Front groove 230 is therefore also generally composed of three parts. When box 170 is in an upright position with opening facing upwards front groove 230 has a front groove first incline or decline part FGFID connected to a front groove substantially horizontal part FGSH, which again is connected to a front groove second incline or decline part FGSID.

As shown in FIG. 11 front groove first incline or decline part FGFID is made up of firstly front left ramp 370 which is at an incline leading to the outside of the box towards the right. Front groove first incline or decline part FGFID is secondly made up of front left taper 390 tapering towards the outside of the box so that the height of the groove remains substantially the same above front left ramp 370.

The front groove substantially horizontal part FGSH of front groove 230 is made up of front upper level portion 380 and front lower level portion 310 as can be seen in FIG. 11. In front, upper level portion 380 is front notch 240. The front groove second incline or decline part FGSID of front groove 230 comprises front right ramp 400 and front right taper 410.

Figure 12:
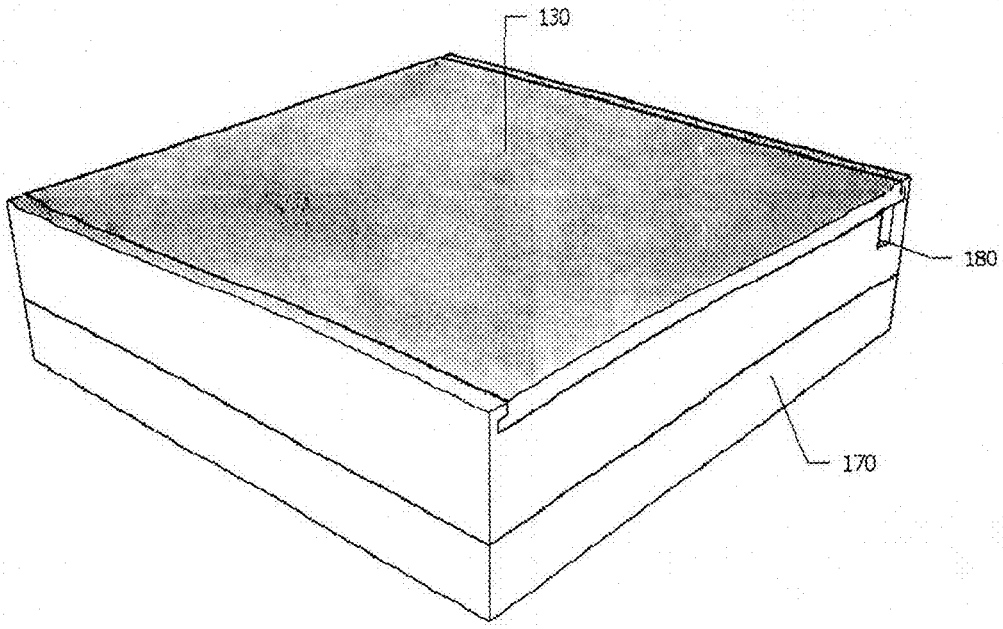
FIG. 12—Shows closed box with sliding lid.

Shown in FIG. 12 is box 170 with sliding lid 130 is in a closed position. When sliding lid 130 is in a closed position front catch 160 shown in FIG. 9 engages front notch 240 shown in FIG. 11 and back catch 250 shown in FIG. 8 engages back notch 150 shown in FIG. 10. The sliding lid 130 is made of flexible, resilient, and or plastic like material that changes shape under pressure but regains its original shape once the force is removed. Its original shape is regained by spring action due to a tendency of the resilient material to regain its original shape.

To open the box force is applied (with a finger) on the sliding lid 130 in a downward vertical direction. Upon application of the force, sliding lid 130 bends inwards or downwards away from the upper level portions (360 in FIGS. 10 and 380 in FIG. 11) and towards the lower level portions (300 in FIGS. 10 and 310 in FIG. 11). In other words, sliding lid 130 under downward vertical pressure from example a person's finger, bends into the substantially horizontal parts of grooves 220 and 230. Due to this bending of the sliding lid 130 the catches move downwards away from the notches and the catch and notch pairs as mentioned disengage. Sliding lid 130 can now move in any side direction.

Figure 13:
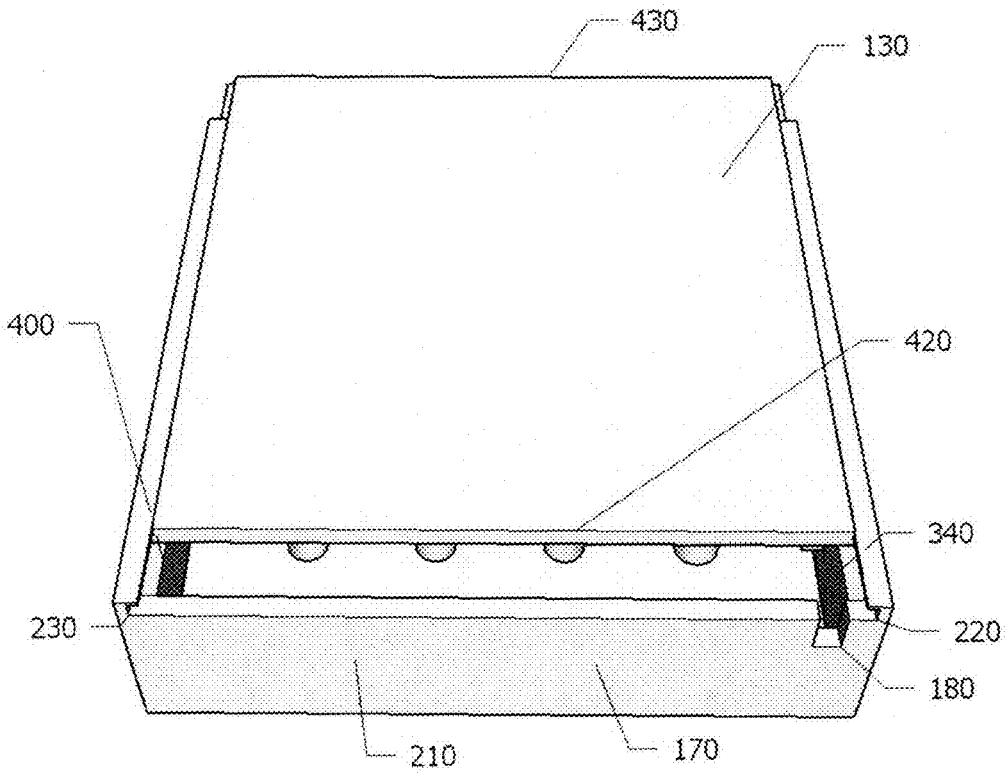
FIG. 13—Shows sliding lid moving to the left with right end on ramps of grooves.

At the same time in order to slide the sliding lid 130 open to for instance the left side a force is simultaneously applied to the left. Once the catches and notches disengage, sliding lid 130 begins to slide towards the left. The left end 430 of sliding lid 130 begins to move out of box 170 as shown in FIG. 13 while front edge 140 of sliding lid 130 slides in front groove 230 shown in FIG. 7 and back edge 290 shown in FIG. 8 slides in back groove 220 shown in FIG. 7. The right end 420 shown in FIG. 13 of sliding lid 130 moves down back right ramp 340 also shown in FIG. 10 and down front right ramp 400 also shown in FIG. 11. Remember FIG. 11 is a view from the back so what is left is actually right shown in FIG. 11 when viewed from the front.

Figure 9:
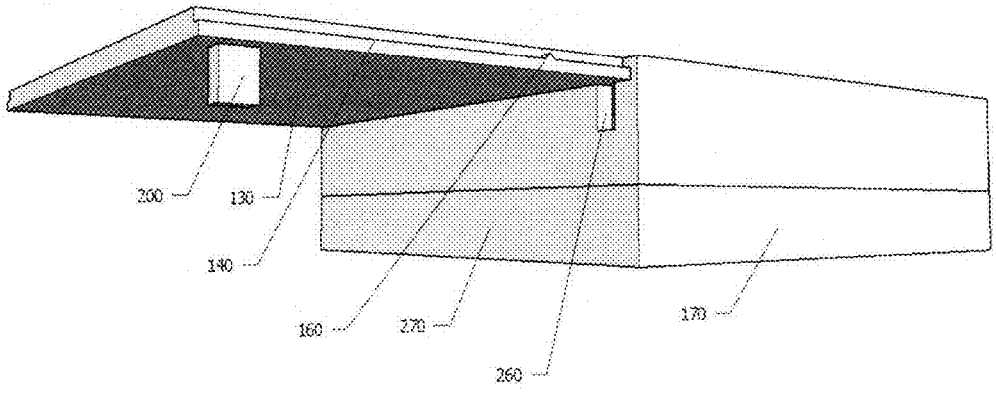
FIG. 9—Shows back and left of box with sliding lid.
Figure 14:
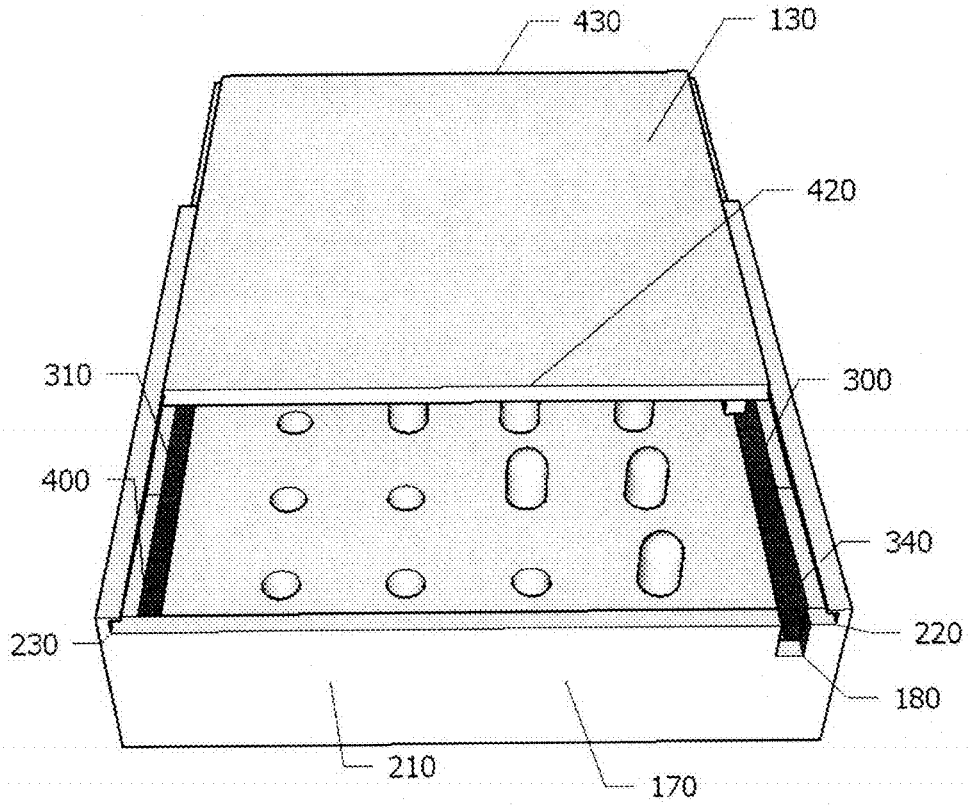
FIG. 14—Shows sliding lid moving left with right end on lower level portions of grooves.

Shown in FIG. 9 front stopper 200 has moved through front right gap 260. In FIG. 14, it can be seen that the movement of sliding lid 130 has progressed where the right end 420 has reached the lower level portions (300 and 310) of grooves 230 and 220. Movement towards the left continues until back stopper 190 shown in FIG. 7 reaches left side 270 shown in FIG. 9. Back stopper 190 presses against and is stopped by left side 270 and left side 270 prevents further movement of sliding lid 130 to the left. Sliding lid 130 therefore does not completely leave the box 170 or slide off box 170. The edges of sliding lid 130 still partially engage the grooves of box 170. Sliding Lid 130 is now in an open position.

When closing the box, the reverse happens of what is described above. Now a force is applied to the right end 430 of sliding lid 130 shown in FIG. 13 in the open position. Sliding lid 130 now moves in the opposite direction towards the right. Right end 420 follows the same path back as it came when the lid was opened.

As sliding lid 130 approaches its closing position the catches approach the notches. Right end 420 is close to right side 210 shown in FIG. 13 and left end 430 close to left side 270 while lid 130 is in a bending position. Due to the bending of sliding lid 130 the catch pair is pushed upwards against the upper level portions 360 and 380. At the back, back catch 250 in FIG. 8 lines up again with back notch 150 in FIG. 10. Front catch 160 in FIG. 7 lines up with front notch 240 in FIG. 8 the catch and notch pairs engage due to the spring action of sliding lid 130 while regaining its shape. Sliding lid 130 is once again in a closed position.

The same happens if the box is opened by sliding or moving sliding lid 130 open towards the right. In this case, back stopper 190 moves through right back gap 180 shown in FIG. 7. Further front stopper 200 is stopped by right side 210 to prevent sliding lid 130 from sliding off box 170.

It should be understood that the notch catch pair combination need not necessarily be v-shaped. They can be of any shape like a dome, arch or they can have the shape of half of a polygon. This invention is not limited to two pairs of notch catch combinations. There can be one, two three or more pairs of notch catch combinations. Further, there need not have to be only one notch for a catch on a side. There may be more than one notch on a side for a catch. By having more than one notch for a catch the extent to which sliding lid slides open can be selected. A container having only one notch in a groove and only one catch on an edge and the catch and notch engaging each other also falls within the scope of the invention. A single catch and notch combination thus also falls within the scope of the invention.

Sliding lid 130 having a single stopper on only one side forms also part of this invention. This will be when the sliding lid can open in only one direction so only one stopper is necessary to prevent the lid from sliding completely off the box. In this case there is no need for a gap in one of the sides.

Figure 15:
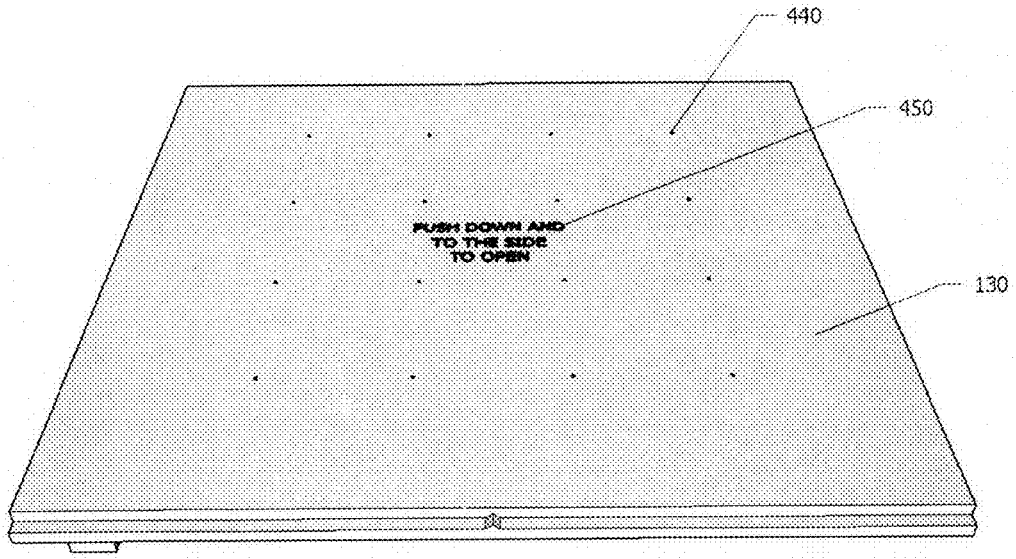
FIG. 15—Shows lid with ventilation holes and opening instructions.

Shown in FIG. 15 is lid 130 with opening instructions 450 and ventilation hole 440 that forms part of a four by four matrix of ventilation holes.

Figure 16:
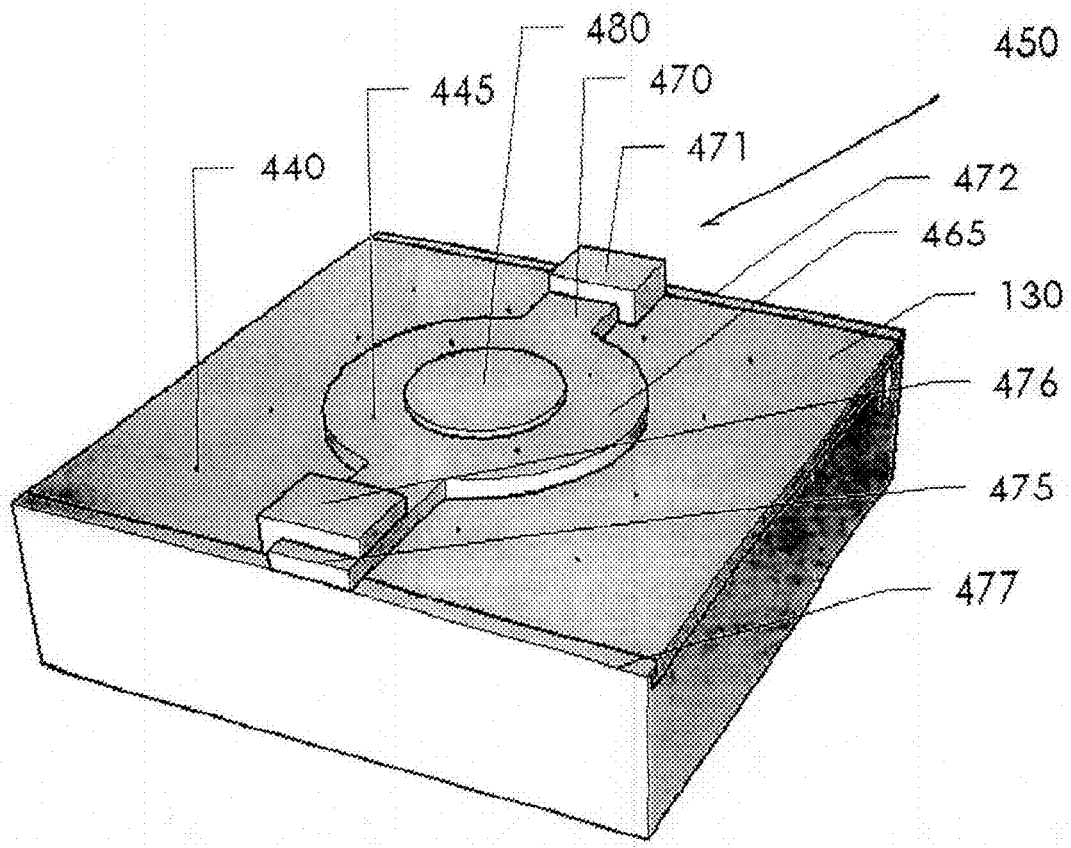
FIG. 16—Shows lid with lock attached in locked position.

Shown in FIG. 16 is lock 450. Lock 450 has first arm 470 connected to circular central part 465. Opposite first arm 470 is second arm 475 180 degrees away relative from first arm 470. Circular central part 465 rotates around swivel 480 which is attached to lid 130. When lid 130 is in closed position first fastener 471 attached to lid 130 is close to a catch and notch combination and second fastener 476 is close to opposite catch and notch combination. When lock 450 is in locked position first arm 470 engages first fastener 471 and is held in place by first fastener 471. Second arm 475 engages second fastener 476 and is held in place by second fastener 476. In this position first arm 470 rest on first side 472 that contain a catch and notch combination and second arm 475 rests on second side 477 that contain a catch and notch combination. As first arm 470 and second arm 475 in FIG. 16 are held in place by the fasteners 471 and 476 lid 130 cannot move in or a bend downward direction close to first fastener 471 and second fastener 476. As first fastener 471 and second fastener 476 is close to the catch and notch combinations this prevents that lid 130 can be bent inwards to disengage the catch and notch combinations. As the catch and notch combination cannot be disengaged the lid cannot be moved to the side and the lid 130 cannot slide open. Also shown in FIG. 16 is ventilation hole 440 and ventilation hole 445 on the lock 450. Both holes form part of a four by four matrix of ventilation holes.

Figure 17:
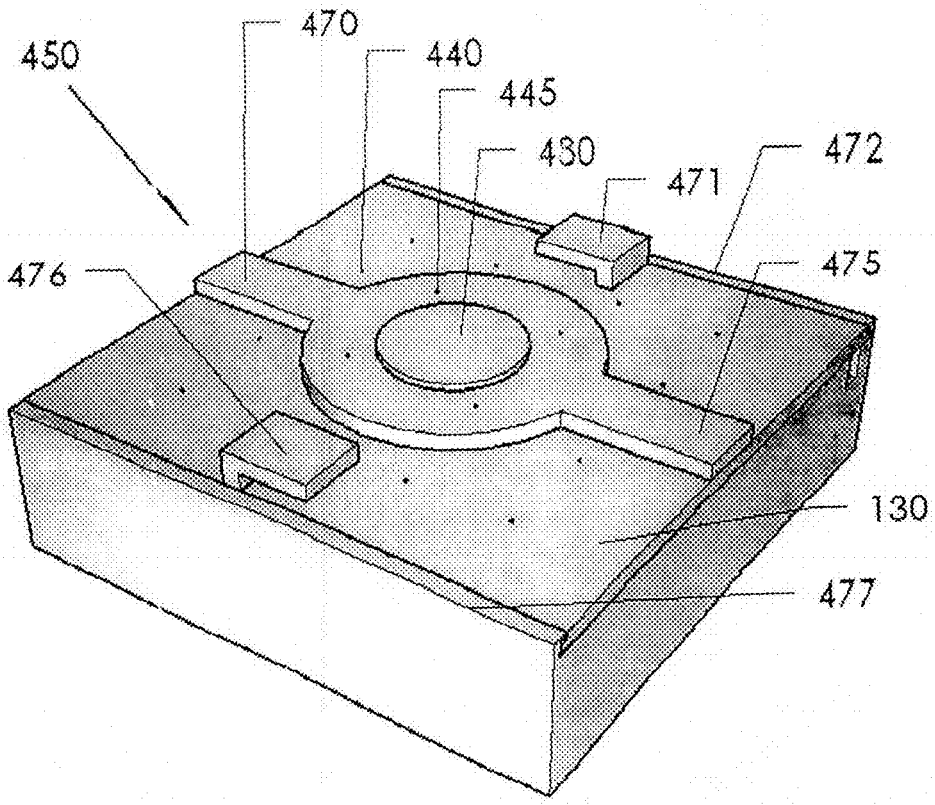
FIG. 17—Shows lid lock attached in unlocked position.

Shown in FIG. 17 is lock 450 in an unlocked position. Lock 450 has now been rotated 90 degrees from a locked position anti-clock wise around swivel 480 to an unlocked position. In this position first arm 470 no longer engages first fastener 471 and no longer rests on first side 472 that contain a catch and notch combination. Further second arm 475 no longer engages second fastener 471 and no longer rests on second side 477 that contain a catch and notch combination. First arm 470 and second arm 475 in FIG. 17 are no longer close and above the catch and notch combinations. Lid 130 can now bend freely where first fastener 471 and second fastener 476 are located which is close to the catch and notch combinations. Lid 130 can now be pushed inwards or downwards and bend and flex to disengage the catch and notch combinations. As the catch and notch combination can be disengaged the lid can be moved to the side and the lid 130 can be slid open.

It must be understood that lock 450 does not have to have two arms. Lock 450 having only one arm also falls within the scope of the invention.

Any reference to any direction, position or orientation such as left, right, up, down, below, incline, decline upper, lower or above should not be construed as imposing any limitation to the invention as to that particular direction, position or orientation. Such references are purely for ease and purposes of describing a particular embodiment of the invention. So for instance as far as the notch and groove combination is concerned having a catch in a groove and a notch on an edge also falls within the scope of this invention.

The invention claimed is:

1. A container comprising:

a box with an opening towards the top;

the box having a first side with an opposing second side and a third side;

the box having a pair of parallel grooves in the first side and second side;

a resilient sliding lid;

the lid having two parallel opposing edges that slidingly engage the grooves;

each edge and groove having a catch and notch combination that engage when the lid is in a closed position;

the grooves having a first incline or decline part connected to a substantially horizontal part which is again connected to a second incline or decline part so that when opening the box the lid is pushed down the lid then bending into the horizontal part, the notch and catch disengaging and the lid is then moved to the third side to open the box and closing the box is accomplished by pushing the lid back towards the closing position and the catch is urged into the notch due to the lid regaining its shape.

2. A container as in claim 1 wherein the lid has a stopper and when the container is opened and the lid slides open the stopper is stopped by the third side of the box and so prevents the lid from sliding off the box.

3. A container as in claim 1 wherein the third side has a gap and the box has opposite the third side a fourth side with a gap;

the lid having two stoppers spaced apart; each stopper having associated with it a gap in one of the third and fourth sides of the box through which it travels if the lid is moved in one direction and if the lid is moved in the opposite direction each stopper having associated with it an opposite side which stops the stopper and so preventing the lid from sliding off the box.

4. A container as in claim 1 wherein the lid has a lock that comprises at least one arm that is rotatable around a swivel that is attached to the lid;

the arm being rotatable into a locking position when the arm engages a fastener attached to the lid and the arm rests on a side of the box that contain the catch and notch combination; preventing the lid from being bent inwards and the catch and notch combination from disengaging and so preventing the lid from being slid open;

the arm being rotatable to an unlocking position when the arm does not engage the fastener and does not rest on a side of the box that contain the catch and notch combination, the lid now being capable of being bent inwards the catch and notch combination then disengaging and the lid can be slid open.

5. A container as in claim 1 wherein the box has a tray to hold measured quantities for human consumption; the tray comprising receptacles for receiving measured quantities; the receptacles being grouped together by dosage or contents of the measured quantities.

6. A container as in claim 1 wherein the box has a tray to hold measured quantities for human consumption; the tray comprising receptacles for receiving measured quantities; the receptacles being grouped together by dosage or contents of the measured quantities; the group in which the receptacles are grouped together being indicated on the tray.

7. A container as in claim 1 wherein the box has a tray to hold measured quantities for human consumption; the tray comprising receptacles for receiving measured quantities; the receptacles having more than one profile; the receptacles being grouped together according to their profile.

8. A container as in claim 1 wherein the box has a tray to hold measured quantities for human consumption; the tray comprising receptacles for receiving measured quantities; the receptacles having more than one profile and the receptacles are being grouped together according to their profile; the measured quantities are being placed in the tray and the measured quantities having profiles that correspond to the profiles of the receptacles.

9. A container as in claim 1 wherein the box has a tray to hold measured quantities for human consumption; the tray comprising receptacles for receiving measured quantities; the receptacles being grouped together by dosage or contents of the measured quantities; the receptacles having resilient structures to accept measured quantities of different diameters or profiles.

10. A container as in claim 1 wherein the box has a tray to hold measured quantities for human consumption; the tray comprising receptacles for receiving measured quantities; the receptacles grouped together by dosage or contents of the measured quantities; the receptacles having resilient structures to accept measured quantities of different diameters or profiles in that the receptacles comprise compressible longitudinal sections arranged like spokes of a wheel in a circle around a central hub zone and the measured quantity being able to fit in the central hub zone.

11. A container as in claim 1 wherein the box has a tray to hold measured quantities for human consumption; the tray comprising receptacles for receiving measured quantities; the receptacles being grouped together by dosage or contents of the measured quantifies; the receptacles having more than one profile and at least one of the receptacles having a resilient structure.

12. A container as in claim 1 wherein the box has a tray to hold measured quantities for human consumption; the tray comprising receptacles for receiving measured quantities and the receptacles grouped together by dosage or contents of the measured quantities; the tray having a measured quantity and the measured quantity containing an indication that is representative of its contents or dosage.

13. A container as in claim 1 wherein the box has a tray to hold measured quantities for human consumption; the tray comprising receptacles for receiving measured quantities; the receptacles grouped together by dosage or contents of the measured quantities; the measured quantity containing an indication by color that is representative of its contents or dosage.

14. A container as in claim 2 wherein the box has a tray to hold measured quantities for human consumption; the tray comprising receptacles for receiving measured quantities; the receptacles being grouped together by dosage or contents of the measured quantities.

15. A container as in claim 2 wherein the box has a tray to hold measured quantities for human consumption; the tray comprising receptacles for receiving measured quantities; the receptacles being grouped together by dosage or contents of the measured quantities; the group the receptacles are grouped together being indicated on the tray.

16. A container as in claim 2 wherein the box has a tray to hold measured quantities for human consumption; the tray comprising receptacles for receiving measured quantities; the receptacles having more than one profile; the receptacles being grouped together according to their profile.

17. A container as in claim 2 wherein the box has a tray to hold measured quantities for human consumption; the tray comprising receptacles for receiving measured quantities; the receptacles having more than one profile; the receptacles are being grouped together according to their profile; the measured quantities are being placed in the receptacles of the tray and the measured quantifies having profiles that correspond to the profiles of the receptacles.

18. A container as in claim 2 wherein the box has a tray to hold measured quantities for human consumption; the tray comprising receptacles for receiving measured quantities; the receptacles being grouped together by dosage or contents of the measured quantities; the receptacles having resilient structures to accept measured quantities of different diameters or profiles.

19. A container as in claim 2 wherein the box has a tray to hold measured quantities for human consumption; the tray comprising receptacles for receiving measured quantities; the receptacles grouped together by dosage or contents of the measured quantities; the receptacles having resilient structures to accept measured quantities of different diameters or profiles in that the receptacles comprise compressible longitudinal sections arranged like spokes of a wheel in a circle around a central hub zone and the measured quantity being able to fit in the central hub zone.

20. A container as in claim 2 wherein the box has a tray to hold measured quantities for human consumption; the tray comprising receptacles for receiving measured quantities; the receptacles being grouped together by dosage or contents of the measured quantities; the receptacles having more than one profile and at least one of the receptacles having a resilient structure.

* * * * *